United States Patent [19]

Novacek

[11] 4,233,583

[45] Nov. 11, 1980

[54] FLUX SHIELDED SOLENOID

[75] Inventor: William G. Novacek, South Egremont, Mass.

[73] Assignee: Bicron Electronics Company, Canaan, Conn.

[21] Appl. No.: 944,793

[22] Filed: Sep. 22, 1978

[51] Int. Cl.[3] ..... H01F 7/08

[52] U.S. Cl. ..... 335/236; 335/301

[58] Field of Search ..... 335/236, 260, 276, 278, 335/301; 336/83, 96

[56] References Cited

U.S. PATENT DOCUMENTS

| | | | |
|---|---|---|---|
| 1,641,473 | 9/1927 | Chylinski | 336/83 |
| 2,628,342 | 2/1953 | Taylor | 336/45 |
| 2,988,715 | 1/1961 | Gizynski et al. | 336/96 |
| 3,082,359 | 3/1963 | Mangiafico | 335/260 X |
| 3,196,322 | 7/1965 | Harper | 335/260 X |
| 3,295,079 | 12/1966 | Brown | 335/255 |
| 3,331,042 | 7/1967 | Erickson et al. | 335/260 |
| 3,332,049 | 7/1967 | Hisano | 336/83 |
| 3,381,251 | 4/1968 | Fuller | 336/83 |
| 3,507,039 | 4/1970 | Craige | 336/83 |
| 3,551,864 | 12/1970 | Sweeney et al. | 336/83 |
| 3,593,241 | 7/1971 | Ludwig | 335/262 |
| 3,598,360 | 8/1971 | Merriner | 335/260 |
| 3,774,298 | 11/1973 | Eley | 336/96 |
| 4,054,854 | 10/1977 | Marsden | 335/260 |

*Primary Examiner*—George Harris

[57] ABSTRACT

A solenoid is disclosed in which a ferromagnetic shield substantially surrounds the circumferential surface of the coil in order to provide a high-permeability flux path on the coil exterior. The shield is formed by a ferromagnetic collar and the body part of a bracket. The ferromagnetic collar extends partially around the coil, and the body part of the bracket faces a longitudinal opening in the ferromagnetic collar. The ferromagnetic collar is embedded in a molded epoxy encapsulation, which is found to be reinforced by the collar. Alternatively, the shield can be formed exclusively of a ferromagnetic collar that extends substantially around the entire periphery of the coil.

4 Claims, 8 Drawing Figures

FLUX SHIELDED SOLENOID

BACKGROUND OF THE INVENTION

The present invention relates to the field of solenoids and in particular to the type in which the solenoid coil is embedded in some kind of thermoset encapsulation.

It is well known in the art of solenoid manufacture to encapsulate solenoid coils in compounds such as epoxy in order to avoid the adverse effects of various environmental factors and to provide mechanical support and protection against mechanical shock. Solenoids of this type often are exposed to rather hostile environments. An example of such environment is a tractor engine in which the solenoid is used for control of fuel flow. Tractors are often left with their engines running, and they sometimes run out of fuel with the ignition left on. In such a situation, the solenoid remains energized, but is not cooled as it normally is when the engine is operating. As a result, substantial heat can be dissipated that is not effectively removed from the solenoid. Accordingly, the thermoset encapsulation can be subjected to severe thermal stresses, particularly in its thinner portions, that can lead to cracking. Thus, it would appear that relatively thin portions of such encapsulations should be avoided whenever possible.

Another factor in solenoid design is the amount of current or voltage that must be applied to the solenoid in order for it to be activated. Many factors are involved in determining the actuation current, of course, but among them is the reluctance of the magnetic path formed in the solenoid. If the reluctance is relatively low, the magnetic flux produced is relatively high, so actuation current and voltage tend to be reduced by reduced reluctance. One method of reducing reluctance, as is shown in Ludwig, U.S. Pat. No. 3,593,241, is to provide a sleeve or shield made of high-permeability material around the periphery of the coil. Such a shield reduces the reluctance seen by the coil, increasing the flux produced and the force experienced by the armature of the solenoid.

Unfortunately, if it is desired to use such a flux shield in an encapsulated solenoid, the above considerations concerning the thickness of the encapsulation would seem to indicate that provision of a flux shield positioned within the encapsulation would require that the size of the solenoid be increased to prevent further diminution of the encapsulation thickness and thus a greater tendency for the encapsulation to crack.

SUMMARY OF THE INVENTION

However, the present invention teaches that provision of a flux shield imbedded in the encapsulation surprisingly decreases the tendency of the encapsulation to crack. This is despite the fact that the encapsulation has been made thinner by the provision of the shield.

According to the present invention, a solenoid assembly includes a coil that has leads and a winding connected electrically between the leads. Current flows through the winding to produce a magnetic field when a potential difference is impressed across the leads. The winding has a longitudinally extending interior surface circumscribing an interior flux path. It also has an exterior surface including two end surfaces and a longitudinal outer surface extending longitudinally between the end surfaces. A ferromagnetic armature is supported for longitudinal movement relative to one of the ends of the coil in response to magnetic flux produced by the coil, and a ferromagnetic shield substantially surrounding the longitudinal surface of the coil provides a high-permeability flux path exterior to and longitudinal of the coil. A thermosetting synthetic resin member extends about the longitudinal surface of the coil, the resin member encasing at least a portion of the shield and being bonded thereto.

Preferably, the part of the flux shield bonded to the encapsulation has a roughened surface formed thereon. In one arrangement, the solenoid assembly includes a bracket that has a body portion and first and second arm portions extending transversly from opposite ends of the said body portion. The body portion lies in a plane extending generally longitudinally of the coil, and the arm portions extend over the end surfaces of the coil. The flux shield includes at least part of the body portion of the bracket and further includes a ferromagnetic collar having a roughened surface formed thereon and extending peripherally only part way around the longitudinal outer surface of the coil, the collar thereby having longitudinal edges that constitute sides of a slot in the collar. The collar is oriented so that the slot faces the body portion of the bracket.

The armature can include an elongated ferromagnetic bar extending longitudinally of the coil and biased to a first position in which it is partially inserted into the interior flux path of the coil. Current greater than predetermined minimum causes enough force to be applied to the elongated bar to move it from the first position to a second position, in which it is further inserted into the interior flux path of the coil. The bar extends from the interior flux path of the coil beyond the plane of a first of the end surfaces of the coil when the armature is in the first position. The solenoid assembly further includes an actuating door pivotally mounted on the bracket, extending over the first end surface of the coil, and connected to the part of the bar extending beyond the plane of the first surface for pivotal movement of the door by the armature when the armature moves between the first position and the second position. Conveniently, a spring means may be fastened between the bracket and the actuating door to bias the actuating door to maintain the armature in the first position when current is not flowing through the coil.

In another arrangement, the flux shield may include a ferromagnetic collar that substantially surrounds the longitudinal outer surface of the coil.

BRIEF DESCRIPTION OF THE DRAWINGS

These and further features and advantages of the present invention can be appreciated by reference to the attached drawings, in which.

DETAILED DESCRIPTION OF THE PREFERRED EMBODIMENTS

Figure 1:
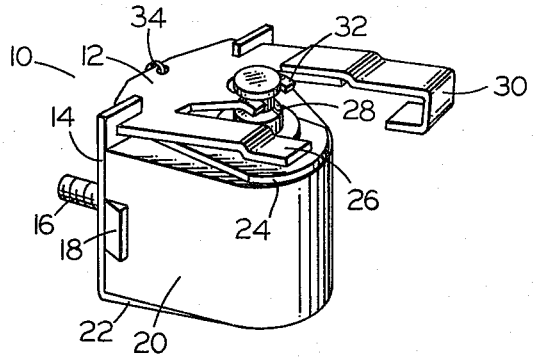
FIG. 1 is a perspective view of a solenoid built according to the teachings of the present invention.

FIG. 1 is a perspective view of a solenoid built according to the teachings of the present invention. The solenoid is indicated generally by reference numeral 10. It includes a molded encapsulation 20 made of a thermoset material such as epoxy in which a coil is embedded. A C-shaped bracket 14 includes two arms 22 and 24 that extend transverse to opposite ends of the body portion of the bracket 14 and that extend over the ends of the epoxy encapsulation 20. A ferromagnetic actuating door 12 is pivotally mounted on the body portion of the bracket 14 by means of slots formed in the sides of the door. The door 12 extends out into an alternate actuating arm 26 and a main actuating arm 30 that terminates in a hook-shaped section provided for attachment to further means not discussed here that are to be actuated by the solenoid.

Figure 2:
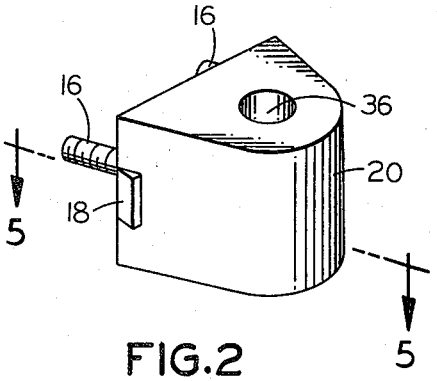
FIG. 2 is a perspective view of the encapsulation in which the coil and flux shield of the present invention are embedded.
Figure 5:
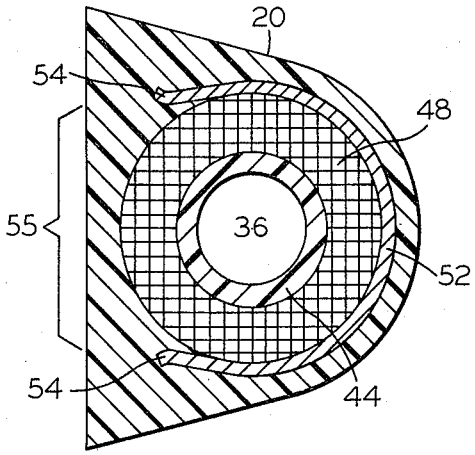
FIG. 5 is a cross section taken at lines 5—5 of FIG. 2.

As is best seen in FIGS. 2 and 5, the molded encapsulation 20 has an axial flux passage 36 circumscribed by the interior surface of the solenoid coil. The solenoid coil is embedded in the epoxy encapsulation 20, its winding 48 being wound on a coil spool 44. The epoxy encapsulation 20 encases a ferromagnetic collar 52 whose purpose is discussed below. The encapsulation material can be any thermosetting synthetic resin, such as epoxy, area formaldehyde, of phenol formaldehyde; epoxy is employed in the illustrated embodiment. It is to be noted that the encapsulating material extends about the longitudinal outer surface of the coil, though it does not necessarily contact it in the area interior to the collar. If the method used to build the solenoid does not provide for interposing the encapsulating material between the collar and the windings, it is necessary to provide insulation between them.

An armature or plunger 28 is shown in FIG. 1 as being oriented coaxial with the coil and partially inserted into its axial interior flux path 36 (FIGS. 2 and 5). A groove formed near the upper end of the armature 28 engages a fork-shaped member 32 that is formed in the actuating door 12 so that movement of the armature 28 causes the door 12 to move pivotally on the bracket 14.

Figure 3:
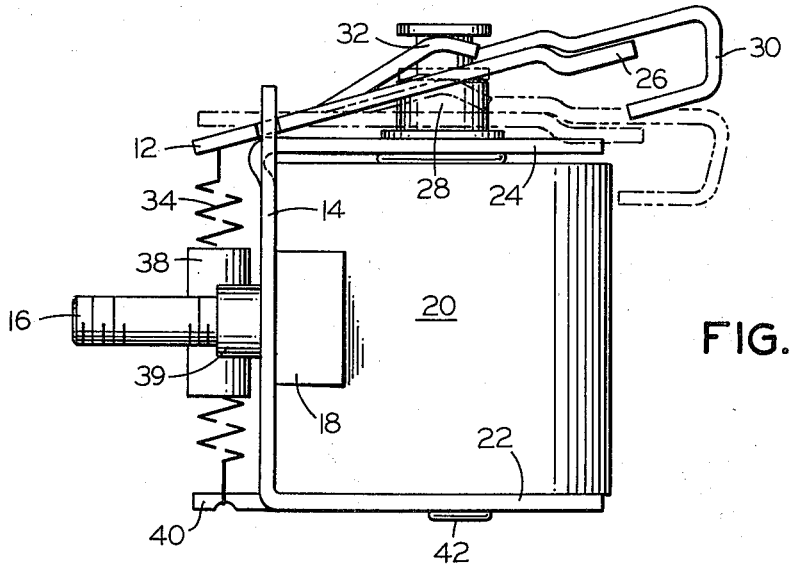
FIG. 3 is a side elevation of the solenoid shown in perspective in FIG. 1.

It can be seen from FIG. 3 that the actuating door 12 is biased by a spring 34. The spring is fastened between the left end of the door 12 and a spring mounting tab 40 that extends to the left of the body part of the bracket 14 as seen in FIG. 3. A vinyl sleeve 38 may be included around the spring 34 if it is desired to change the natural frequency of the spring to avoid vibration. The spring 34 biases the actuating door 12 to the position shown in FIG. 1, but when the solenoid is energized, the actuating door 12 is moved against the bias force to a second position shown in phantom in FIG. 3. Mounting studs 16, which serve both for mounting purposes and as electrical connections to the coil windings 48, protrude from the encapsulation 20 and through the body portion of the bracket 14, from which they are insulated by nonconductive mounting sleeves 39.

A protrusion 18 in the encapsulation 20 is observed in FIGS. 1, 2, and 3. Such protrusions may be provided to accommodate various members embedded in the encapsulation 20. In this case, the protrusions 18 are provided to accommodate hexagonal extensions of the mounting studs 16 interior to the encapsulation 20.

Figure 4:
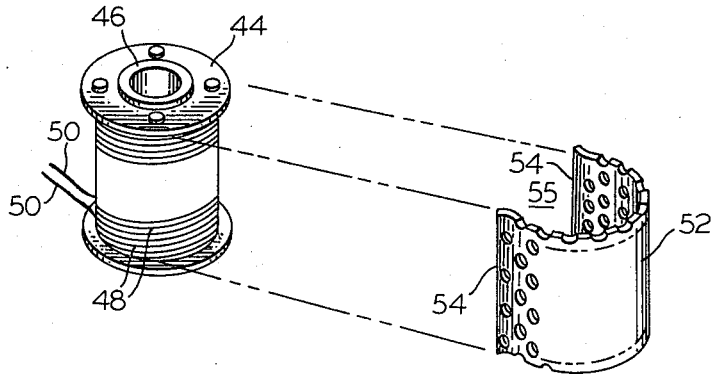
FIG. 4 is an exploded view of the coil and ferromagnetic collar that are embedded in the encapsulation shown in FIG. 2.

The ferromagnetic collar 52 shown in section in FIG. 5 is shown in perspective FIG. 4. The windings 48 of the coil are shown terminating in leads 50 that, as is not shown in FIG. 4, are electrically connected to the mounting studs 16 seen in FIGS. 1, 2, and 3. The windings 48 are wound on the winding sleeve 46 of a spool 44, and the ferromagnetic collar 52 clamps over the windings. Ferromagnetic collar 52 is perforated to roughen the surface for bonding to the encapsulation. When in place as seen in FIG. 5, it extends only partially around the circumferential surface of the coil. It therefore has longitudinal edges 54 defining a longitudinal opening 55 that faces the body portion of the bracket 14 when the solenoid is assembled in the bracket.

Figure 6:
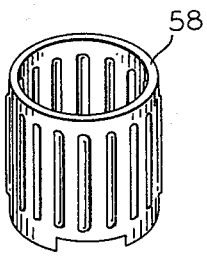
FIG. 6 is a perspective view of an alternate embodiment of the ferromagnetic collar shown in FIGS. 4 and 5.

As will be described below, the ferromagnetic collar 52 and the body portion of the bracket 14 together substantially surround the coil to form a flux shield that reduces the voltage required for actuation of the solenoid. Alternately, a flux shield 58 as seen in FIG. 6 could be employed that entirely surrounds the coil. It will be noted that unlike the perforated collar 52 of FIG. 4, the collar 58 of FIG. 6 is roughened by ribs instead of perforations. The collars are roughened for good bonding to the epoxy encapsulation 20. This can be done in a number of ways, including the two methods shown in the drawings and other methods such as etching. However, the provision of perforations has proved preferable.

Figure 7:
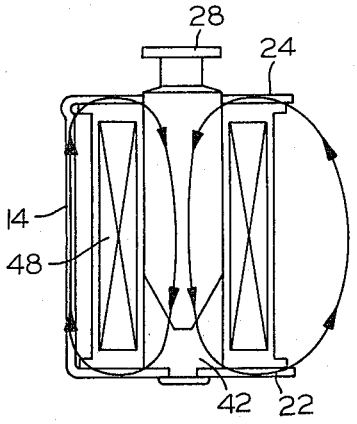
FIG.7 (PRIOR ART)
FIG. 7 is a diagrammatic cross-sectional view showing the flux path resulting in a solenoid that does not employ the flux shield of the present invention.
Figure 8:
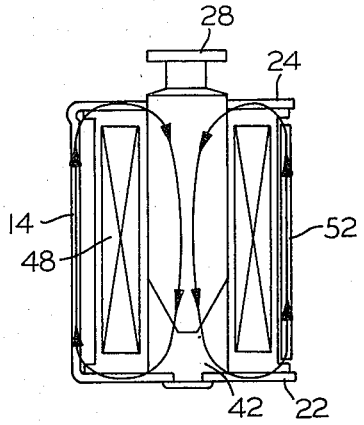
FIG. 8 is a view similar to that in FIG. 7 showing the flux path that results when the flux shield of the present invention is employed.

If attention is now directed to FIGS. 7 and 8, it can be seen why the flux shield of the present invention is employed. In FIG. 7, the armature 28 is shown in the actuated position, in which its conical lower end is received in a mating surface provided for it it in a ferromagnetic core 42 that is secured to the lower arm 22 of the bracket 14. This is the result of the application of voltage to the mounting studs 16, which causes current to flow through the coils to produce magnetic flux and magnetic force in the well-known manner. Due to the high magnetic permeability of the materials of which they are made (typically carbon steel, though any ferromagnetic material can be employed), the preferred flux path is as seen in FIG. 7, where one flux path is shown that includes the armature 28, the core 42, the lower arm 22, the body portion, and the upper arm 24 of the bracket 14. The flux path just described offers low reluctance, thus permitting a relatively high amount of magnetic flux and a correspondingly large force on the armature or plunger 28. However, the total flux is not as high as it might be, because the other right-hand flux path shown in FIG. 7 contains a substantial air gap between the upper arm 24 and the lower arm 22 of the bracket 14. Thus this path includes the lower arm 22, the core 42, the armature or plunger 28, and the upper arm 24, all of which are ferromagnetic, but it also includes a long air gap. The presence of the air gap limits the flux produced and thus causes a relatively weak magnetic force to be experienced by the armature. This contributes to the requirement of a relatively high actuating voltage. This is particularly true because the right-hand flux path is representative of most of the cross section of the solenoid.

With the ferromagnetic collar 52 included, an effective flux shield is provided that substantially increases the overall permeability of the flux paths seen by the solenoid coil 48, so the amount of flux produced by a given amount of current is greater for the solenoid shown in FIG. 8 than it is for the solenoid of FIG. 7. In FIG. 8 the right-hand flux path, which as mentioned before is representative of most of the cross section of the solenoid, includes the lower bracket arm 22, the core 42, the plunger 28, and the upper arm 24 as before, but instead of the air gap shown in FIG. 7, the flux path of FIG. 8 includes the ferromagnetic collar 52. As previously observed, this effects a substantial reduction in reluctance and thus a substantial increase in magnetic flux.

As seen in FIG. 5, the inclusion of the ferromagnetic collar 52 has the effect of reducing the thickness of the epoxy encapsulation 20 at its thinnest points. In the past, the thinness of this area of the encapsulation contributed to the likelihood that cracking would occur at that location. Thus, the further thinning of this encapsulation area would appear to be a disadvantage. However, the inclusion of the flux shield surprisingly has not proved to cause an increase in the incidence of cracking due to the thinning of the encapsulation 20. As a matter of fact, it actually reduces the incidence of cracking to below that which would be encountered in the absence of the flux shield. Accordingly, through the employment of the teachings of the present invention, practitioners of the art not only will be able to improve performance due to the reduced operating voltages necessary with the shield of the present invention, but also will obtain a greater ability to withstand the stresses to which such encapsulated solenoids are typically exposed.

Having thus described the invention, I claim:

1. In a solenoid assembly the combination comprising:

a. a coil including leads and a winding connected electrically between said leads for flow of current through said winding to produce a magnetic field when a potential difference is impressed across said leads, said winding having a longitudinally extending interior surface circumscribing an interior flux path and also having an exterior surface including two end surfaces and a longitudinal outer surface extending longitudinally between said end surfaces;

b. a ferromagnetic armature supported for longitudinal movement relative to one of said ends of said coil in response to magnetic flux produced by said coil, said armature including an elongated ferromagnetic bar extending longitudinally of said coil and biased to a first position in which it is partially inserted into the interior flux path of said coil, current greater than predetermined minimum causing enough force to be applied to said bar to move it from said first position to a second position in which it is further inserted into the interior flux path of said coil;

c. a bracket including a body portion and first and second arm portions extending transversely from opposite ends of said body portion, said body portion lying in a plane extending generally longitudinally of the axis of said coil, said arm portions extending over said end surfaces of said coil, said bar extending from said interior flux path of said coil beyond the plane of a first of said end surfaces of said coil when said armature is in said first position;

d. an actuating door pivotally mounted on said bracket, extending over said first end surface of said coil, and connected to the part of said bar extending beyond the plane of said first surface for pivotal movement of said door when said armature moves between said first position and said second position;

e. a ferromagnetic collar substantially surrounding said longitudinal surface of said coil to provide a high-permeability flux path exterior to and longitudinal of said coil; and f. a thermosetting synthetic resin member extending about said longitudinal surface of said coil, said resin member encasing at least a portion of said collar and being bonded thereto.

2. The solenoid assembly of claim 1 wherein said part of said collar bonded to said synthetic resin member has a roughened surface formed thereon.

3. The solenoid assembly of claim 1 or 2, further including a spring means fastened between said bracket and said actuating door to bias said actuating door to maintain said armature in said first position when current is not flowing through said coil.

4. The solenoid assembly of claim 1 or 2, further including a spring means fastened between said bracket and said actuating door to bias said actuating door to maintain said armature in said position when no current flows through said coil.

* * * * *